US008808112B2

(12) United States Patent
Morgan et al.

(10) Patent No.: US 8,808,112 B2
(45) Date of Patent: Aug. 19, 2014

(54) GOLF BALL HAVING VISUALLY ENHANCED NON-UNIFORM THICKNESS INTERMEDIATE LAYER

(75) Inventors: William E. Morgan, Barrington, RI (US); Michael J. Sullivan, Barrington, RI (US); Matthew F. Hogge, Plymouth, MA (US)

(73) Assignee: Acushnet Company, Fairhaven, MA (US)

( * ) Notice: Subject to any disclaimer, the term of this patent is extended or adjusted under 35 U.S.C. 154(b) by 780 days.

(21) Appl. No.: 13/017,549

(22) Filed: Jan. 31, 2011

(65) Prior Publication Data

US 2011/0124438 A1 May 26, 2011

Related U.S. Application Data

(60) Division of application No. 12/140,679, filed on Jun. 17, 2008, now Pat. No. 7,901,301, which is a continuation-in-part of application No. 11/707,493, filed on Feb. 16, 2007, now Pat. No. 7,722,483.

(51) Int. Cl.
*A63B 37/06* (2006.01)

(52) U.S. Cl.
USPC ..... 473/377

(58) Field of Classification Search
USPC ..... 473/378, 377
See application file for complete search history.

(56) References Cited

U.S. PATENT DOCUMENTS

| | | | |
|---|---|---|---|
| 2,809,954 | A | 10/1957 | Kazenas |
| 2,851,424 | A | 9/1958 | Switzer et al. |
| 2,938,873 | A | 5/1960 | Kazenas |
| 3,253,146 | A | 5/1966 | de Vries |
| 3,412,036 | A | 11/1968 | McIntosh |
| D228,394 | S | 9/1973 | Martin et al. |
| 3,989,568 | A | 11/1976 | Isaac |
| 4,123,061 | A | 10/1978 | Dusbiber |
| 4,128,600 | A | 12/1978 | Skinner et al. |
| 4,317,933 | A | 3/1982 | Parker |
| 4,342,793 | A | 8/1982 | Skinner et al. |
| 4,560,168 | A | 12/1985 | Aoyama |
| 4,679,795 | A | 7/1987 | Melvin et al. |
| 4,798,386 | A | 1/1989 | Berard |
| 4,804,189 | A | 2/1989 | Gobush |

(Continued)

FOREIGN PATENT DOCUMENTS

| | | |
|---|---|---|
| JP | 2001-087423 | 4/2001 |

OTHER PUBLICATIONS

Mark S. Murphy; "Just Different Enough" Golf World Business; Apr. 8, 2005; p. 2.

(Continued)

*Primary Examiner* — Raeann Gorden
(74) *Attorney, Agent, or Firm* — Margaret C. Barker

(57) ABSTRACT

A golf ball with at least one core layer, at least one intermediate layer, and at least one cover layer. Any combination of the layers of the golf ball may feature a visually enhancing means. The cover layer is preferably translucent and provides a view to the intermediate layer and/or the core layer. The intermediate layer has a non-uniform thickness. The core may comprise a non-spherical insert. The intermediate layer and the core layer may affect the spin rate of the golf ball. The intermediate layer may be used to indicate the alignment of the golf ball.

6 Claims, 7 Drawing Sheets

(56) References Cited

U.S. PATENT DOCUMENTS

| | | | |
|---|---|---|---|
| 4,921,759 | A | 5/1990 | Orain et al. |
| 4,925,193 | A | 5/1990 | Melvin |
| 4,950,696 | A | 8/1990 | Palazotto et al. |
| 4,960,281 | A | 10/1990 | Aoyama |
| 4,985,340 | A | 1/1991 | Palazzotto et al. |
| 4,991,852 | A | 2/1991 | Pattison |
| 4,998,734 | A | 3/1991 | Meyer |
| 5,000,458 | A | 3/1991 | Proudfit |
| 5,018,742 | A | 5/1991 | Isaac et al. |
| 5,143,377 | A | 9/1992 | Oka et al. |
| 5,147,900 | A | 9/1992 | Palazzotto et al. |
| 5,156,405 | A | 10/1992 | Kitaoh et al. |
| 5,249,804 | A | 10/1993 | Sanchez |
| 5,256,170 | A | 10/1993 | Harmer et al. |
| 5,326,621 | A | 7/1994 | Palazzotto et al. |
| 5,334,673 | A | 8/1994 | Wu |
| 5,360,462 | A | 11/1994 | Harmer et al. |
| 5,376,428 | A | 12/1994 | Palazzotto et al. |
| 5,427,378 | A | 6/1995 | Murphy |
| 5,442,680 | A | 8/1995 | Schellinger et al. |
| 5,484,870 | A | 1/1996 | Wu |
| 5,494,291 | A | 2/1996 | Kennedy |
| 5,562,552 | A | 10/1996 | Thurman |
| 5,575,477 | A | 11/1996 | Hwang |
| 5,605,761 | A | 2/1997 | Burns et al. |
| 5,672,643 | A | 9/1997 | Burns et al. |
| 5,674,622 | A | 10/1997 | Burns et al. |
| 5,688,191 | A | 11/1997 | Cavallaro et al. |
| 5,692,974 | A | 12/1997 | Wu et al. |
| 5,713,801 | A | 2/1998 | Aoyama |
| 5,783,293 | A | 7/1998 | Lammi |
| 5,800,286 | A | 9/1998 | Kakiuchi et al. |
| 5,803,831 | A | 9/1998 | Sullivan et al. |
| 5,820,488 | A | 10/1998 | Sullivan et al. |
| 5,823,890 | A | 10/1998 | Maruko et al. |
| 5,823,891 | A | 10/1998 | Winskowicz |
| 5,840,788 | A | 11/1998 | Lutz et al. |
| 5,885,172 | A | 3/1999 | Hebert et al. |
| 5,900,439 | A | 5/1999 | Prissok et al. |
| 5,902,191 | A | 5/1999 | Masutani et al. |
| 5,919,100 | A | 7/1999 | Boehm et al. |
| 5,929,189 | A | 7/1999 | Ichikawa et al. |
| 5,938,544 | A | 8/1999 | Winskowicz |
| 5,957,786 | A | 9/1999 | Aoyama |
| 5,957,787 | A | 9/1999 | Hwang |
| 5,965,669 | A | 10/1999 | Cavallaro et al. |
| 5,981,654 | A | 11/1999 | Rajagopalan |
| 5,981,658 | A | 11/1999 | Rajagopalan |
| 5,989,135 | A | 11/1999 | Welch |
| 5,993,968 | A | 11/1999 | Umezawa et al. |
| 6,056,842 | A | 5/2000 | Dalton et al. |
| 6,083,119 | A | 7/2000 | Sullivan et al. |
| 6,120,394 | A | 9/2000 | Kametani |
| 6,149,535 | A | 11/2000 | Bissonnette et al. |
| 6,152,834 | A | 11/2000 | Sullivan |
| 6,200,232 | B1 | 3/2001 | Kasashima et al. |
| 6,207,784 | B1 | 3/2001 | Rajagopalan |
| 6,251,991 | B1 | 6/2001 | Takesue et al. |
| 6,277,037 | B1 | 8/2001 | Winskowicz et al. |
| 6,315,681 | B1 * | 11/2001 | Sullivan ..... 473/373 |
| 6,358,160 | B1 | 3/2002 | Winskowicz |
| 6,369,125 | B1 | 4/2002 | Nesbitt |
| 6,450,902 | B1 | 9/2002 | Hwang |
| 6,548,618 | B2 | 4/2003 | Sullivan et al. |
| 6,558,227 | B1 | 5/2003 | Kodaira et al. |
| 6,565,455 | B2 | 5/2003 | Hayashi et al. |
| 6,565,456 | B2 | 5/2003 | Hayashi et al. |
| 6,790,149 | B2 | 9/2004 | Kennedy et al. |
| 6,824,476 | B2 | 11/2004 | Sullivan et al. |
| 6,872,154 | B2 | 3/2005 | Shannon et al. |
| 6,949,595 | B2 | 9/2005 | Morgan et al. |
| 7,090,798 | B2 | 8/2006 | Hebert et al. |
| 7,291,076 | B2 | 11/2007 | Watanabe |
| 2002/0086743 | A1 | 7/2002 | Bulpett |
| 2003/0158000 | A1 | 8/2003 | Kennedy et al. |
| 2004/0176184 | A1 | 9/2004 | Morgan et al. |
| 2004/0176185 | A1 | 9/2004 | Morgan et al. |
| 2004/0176188 | A1 | 9/2004 | Morgan et al. |
| 2005/0148409 | A1 | 7/2005 | Morgan et al. |
| 2005/0197211 | A1 | 9/2005 | Sullivan et al. |

OTHER PUBLICATIONS

Wilson Hope golf ball, http://www.pargolf.com/products/Wilson-Hope.htm, Jan. 27, 2005.

Color photographs of Volvik "Crystal" golf ball and packaging, 2005.

Volvik Crystal golf ball, http://www.volvik.co.kr/english/product/crystal.asp, Jan. 21, 2005.

Volvik Golf Ball Brochure, 2005, pp. 1, 16-17 and 24.

Color photographs of Volvik "Crystal" golf ball, 2004.

Color photographs of Wilson "iWound", display model only with clear cover, 2001.

"Urea", Kirk-Othmer Encyclopedia of Chemical Technology. John Wiley & Sons, Inc. copyright 1998.

Color Photographs of Wilson "Quantum" golf ball, late 1990s.

Color Photographs of Pro Keds "Crystal π" golf ball, 1980's.

"Optical brightener" in Kirk-Othmer, Encyclopedia of Chemical Technology, 3d Edition, vol. 4, p. 213.

* cited by examiner

GOLF BALL HAVING VISUALLY ENHANCED NON-UNIFORM THICKNESS INTERMEDIATE LAYER

CROSS-REFERENCE TO RELATED APPLICATION

This application is a division of U.S. patent application Ser. No. 12/140,679, filed on Jun. 17, 2008, now U.S. Pat. No. 7,901,301, which is a continuation-in-part of U.S. patent application Ser. No. 11/707,493, filed on Feb. 16, 2007, now U.S. Pat. No. 7,722,483, which is incorporated herein by reference in its entirety.

FIELD OF THE INVENTION

This invention relates to golf balls, and more particularly, to a visually enhanced golf ball with an intermediate layer of non-uniform thickness wherein a translucent cover makes the intermediate layer visible.

BACKGROUND OF THE INVENTION

Golf balls, whether of solid or wound construction, generally include a core and a cover. It is known in the art to modify the properties of a conventional solid ball by altering the typical single layer core and single cover layer construction to provide a ball having at least one mantle layer disposed between the cover and the core. The core may be solid or liquid-filled, and may be formed of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or, in many cases, be formed of a tensioned elastomeric winding, which are referred to as wound balls. The difference in play characteristics resulting from these different types of constructions can be quite significant. The playing characteristics of multi-layer balls, such as spin and compression, can be tailored by varying the properties of one or more of these intermediate and/or cover layers.

Manufacturers generally provide the golf ball with a durable cover material, such as an ionomer resin, or a softer cover material, such as polyurethane. Chemically, ionomer resins are a copolymer of an olefin and an α,β-ethylenically-unsaturated carboxylic acid having 10-90% of the carboxylic acid groups neutralized by a metal ion and are distinguished by the type of metal ion, the amount of acid, and the degree of neutralization. Commercially available ionomer resins include copolymers of ethylene and methacrylic or acrylic acid neutralized with metal salts. Examples include SURLYN® from E.I. DuPont de Nemours and Co. of Wilmington, Del. and IOTEK® from Exxon Corporation of Houston, Tex.

Surrounding the core with an ionomeric cover material provides a ball that is virtually indestructible by golfers. The core/cover combination permits golfers to impart a high initial velocity to the ball that results in improved distance.

Polyurethanes are used in a wide variety of applications including adhesives, sealants, coatings, fibers, injection molding components, thermoplastic parts, elastomers, and both rigid and flexible foams. Polyurethane can be produced by the product of a reaction between a polyurethane prepolymer and a curing agent. The polyurethane prepolymer is generally a product formed by a reaction between a polyol and a diisocyanate. The curing agents used previously are typically diamines or glycols. A catalyst is often employed to promote the reaction between the curing agent and the polyurethane prepolymer.

Since about 1960, various companies have investigated the usefulness of polyurethane as a golf ball cover material. U.S. Pat. No. 4,123,061 teaches a golf ball made from a polyurethane prepolymer of polyether and a curing agent, such as a trifunctional polyol, a tetrafunctional polyol, or a fast-reacting diamine. U.S. Pat. No. 5,334,673 discloses the use of two categories of polyurethane available on the market, i.e., thermoset and thermoplastic polyurethanes, for forming golf ball covers and, in particular, thermoset polyurethane covered golf balls made from a composition of polyurethane prepolymer and a slow-reacting amine curing agent, and/or a difunctional glycol.

Additionally, U.S. Pat. No. 3,989,568 discloses a three-component system employing either one or two polyurethane prepolymers and one or two polyol or fast-reacting diamine curing agents. The reactants chosen for the system must have different rates of reactions within two or more competing reactions.

The color instability caused by both thermo-oxidative degradation and photodegradation typically results in a "yellowing" or "browning" of the polyurethane layer, an undesirable characteristic for urethane compositions are to be used in the covers of golf balls, which are generally white.

U.S. Pat. No. 5,692,974 to Wu et al. discloses golf balls which have covers and cores and which incorporate urethane ionomers. The polyurethane golf ball cover has improved resiliency and initial velocity through the addition of an alkylating agent such as t-butyl chloride to induce ionic interactions in the polyurethane and thereby produce cationic type ionomers. UV stabilizers, antioxidants, and light stabilizers may be added to the cover composition.

U.S. Pat. No. 5,484,870 to Wu discloses a golf ball cover comprised of a polyurea. Polyureas are formed from reacting a diisocyanate with an amine.

U.S. Pat. No. 5,823,890 to Maruko et al., discloses a golf ball formed of a cover of an inner and outer cover layer compression molded over a core. The inner and outer cover layers should have a color difference ΔE in Lab color space of up to 3.

U.S. Pat. No. 5,840,788 to Lutz et al. discloses a UV light resistant, visibly transparent, urethane golf ball topcoat composition for use with UV curable inks. The topcoat includes an optical brightener that absorbs at least some UV light at wavelengths greater than about 350 nm, and emits visible light, and a stabilizer package. The light stabilizer package includes at least one UV light absorber and, optionally, at least one light stabilizer, such as a HALS.

U.S. Pat. No. 5,494,291 to Kennedy discloses a golf ball having a fluorescent cover and a UV light blocking, visibly transparent topcoat. The cover contains a fluorescent material that absorbs at least some UV light at wavelengths greater than 320 nm and emits visible light.

Colored golf balls have been produced for many years. In the 1960s Spalding produced a yellow range ball with a blended cover that included polyurethane.

U.S. Pat. No. 4,798,386, to Berard, makes reference to white cores and transparent covers and even locating decoration on the core to be visible through the transparent cover. The Berard concept requires a core which has a satisfactory hue to achieve the desired finished ball coloration. A polybutadiene rubber core of such a color has never been produced and as such, transparent cover 2-pc ball have had limited market success.

U.S. Pat. No. 4,998,734 to Meyer, describes a golf ball with a core, a transparent cover and "layer interdisposed therebetween." However, the intermediate layer described is a thin layer of paper or plastic material whose purpose is only to bear textural, alphanumeric or graphical indicia. Meyer teaches that the layer should be sufficiently thin to permit substantial transference of impact forces from the cover to the core without substantially reducing the force.

The Pro Keds "Crystal π" golf ball appeared in the Japanese market. It had a white core bearing the ball markings and a transparent Surlyn cover. This ball had a very thick transparent cover (>0.065") and the surface dimple coverage was very low.

In the early 1990s, Acushnet made transparent Surlyn cover, two-piece Pinnacle Practice balls. The covers were 0.050" thick.

A prototype Wilson Surlyn covered two-piece ball, "Quantum", of a design similar to the Pro Keds ball was found in the US in the late 1990s. The cover was greater than 0.065 inches thick.

U.S. Pat. No. 5,442,680, Proudfit is directed to a golf ball with a transparent ionomer cover. The patent requires a blend of ionomers with different cations.

In the early 1990s a solid one-piece urethane golf ball having a hole for the insertion of a chemi-luminescent tube was sold as a "Night Golf" ball. It was relatively translucent to create the glow, but it was far from having the performance characteristics of standard golf balls.

Two-piece balls have been sold under the tradename "Glow Owl" which utilize a white core and a cover with glow in the dark materials. This ball is believed to embody the technology described in U.S. Pat. No. 5,989,135 to Welch, which describes a "partially translucent" cover.

At the January 2001 PGA Show, Wilson displayed samples of "iWound" golf balls with transparent covers. They were not balls for actual play but mock-ups used to display their new "lattice wound" technology. The lattice (discontinuous inner cover layer) was Hytrel and the Surlyn outer cover layer was transparent. Both the Hytrel lattice and red core were visible through the transparent cover. No markings were on the core or lattice.

To date, it has been difficult for manufacturers to simultaneously improve the performance and aesthetic qualities of golf balls. A golf ball featuring a performance enhancing non-uniform thickness layer or non-spherical core insert which is not shrouded from view by an opaque cover would be a welcome contribution to the art. There exists a particular need in the art for a golf ball with a non-uniform thickness layer or non-spherical core insert which is made visually pleasing by the addition of pigments or dyes, and which is visible through one or more transparent layers.

SUMMARY OF THE INVENTION

The present invention concerns a golf ball comprising at least one core layer, at least one intermediate layer encasing the at least one core layer, and at least one cover layer encasing the at least one intermediate layer. The cover layer of the golf ball is translucent. In some embodiments the intermediate layer and/or the core layer are translucent. At least one intermediate layer has a non-uniform thickness and may comprise a plurality of projections disposed thereon. The cover layer or the intermediate layer comprises a visually enhancing means, including at least one of: metallics, fluorescents, phosphorescents, luminescents, pearlescents, optical brighteners, edge-effect pigments, pigments, dyes and/or tinting agents. In some embodiments, the core layer comprises a visually enhancing means. In some embodiments, the intermediate layer of non-uniform thickness comprises an alignment indicator which indicates the orientation of the golf ball in space.

The present invention also relates to a golf ball comprising at least one core layer, at least one intermediate layer encasing the at least one core layer, and at least one cover layer encasing the at least one intermediate layer. The cover layer of the golf ball is translucent. In some embodiments the intermediate layer and/or the core layer are translucent. The core comprises a non-spherical insert. In some embodiments, the non-spherical core insert is at least partially visible. In some embodiments, the non-spherical core insert comprises materials of non-uniform density. The golf ball has at least one layer comprising a visually enhancing means.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

The present invention contributes a unique synergy of translucent outer layers, non-uniform thickness layers and other visually enhancing means to golf ball art. The translucent outer layers confer a sense of depth to the golf ball. They allow players to perceive beyond the outer surface to the intermediate or even core layers. These layers are important because they both enable the modification of the spin rate, compression, and flexular modulus of the ball. The translucent outer layers allow the golfers to see and appreciate the technological advances included in the ball. For instance, when the intermediate layer has a non-uniform thickness and contains fluorescent dyes and/or pigments, the edges of this layer are highlighted by the dyes and/or pigments and will enhance the player's perception of the depth of the ball. Similarly, technologically advanced non-spherical core inserts may be viewable. Visually enhancing means, generally understood to be coloring means such as dyes and/or pigments incorporated into one or more of the layers, are aesthetically appealing in their own right, but they also help to visually feature the non-uniform intermediate layer and/or the core insert.

The visually enhancing means may also be used to highlight the contrast between layers. For instance, if the non-uniform thickness layer is made into a wave-like pattern, and when this layer incorporates a visually enhancing means such as special-effect pigments or metallic pigments, then light will be reflected from these pigments differently. A particularly unexpected synergy arises when edge-effect pigments are used. These pigments are so named because they are attracted to the edges or sharper contours of the surfaces to which they are applied. This effect highlights the contours and geometry of the non-uniform intermediate layer or the core insert.

The broad importance of perception to the game of golf should be emphasized. Golfers rely on their sensory perception to play golf. Golfers frequently mention "the feel" of a golf ball and desire golf balls with certain criteria that fall under this rubric. Scientifically, this can be understood to mean that golfers have the ability to perceive the compression, hardness, or coefficient of restitution of golf balls and that they select golf balls using this criteria among many. Therefore, a significant amount of golf ball art can be seen as inventions which explore advantages to the golfer's sense of touch. In like manner, the present invention may be viewed in part as a novel foray into the art, not of "the feel," but of "the visual aspect" of the game of golf.

Figure 1:
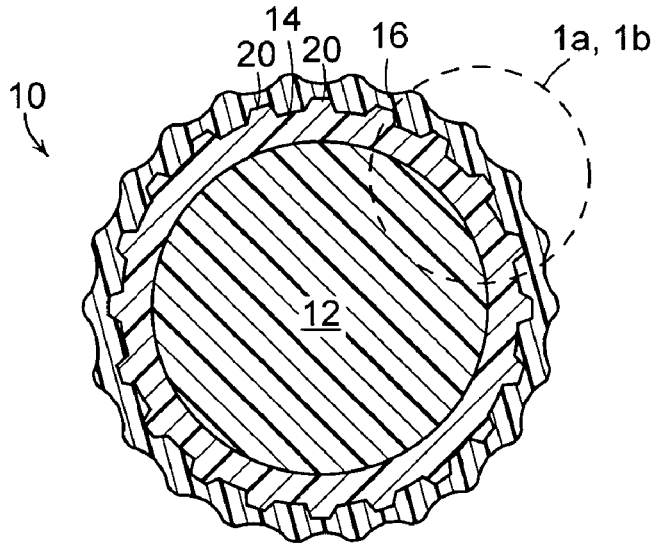
FIG. 1 is a cross-sectional view of a golf ball with a non-uniform thickness layer in accordance with the present invention.

Referring now to the drawings, and more particularly, to FIG. 1, there is shown a golf ball, generally designated 10, which comprises a preferred embodiment of the present invention. Golf ball 10 includes core layer 12, intermediate layer 14, and cover layer 16. Intermediate layer 14 encases core layer 12, and cover layer 16 encases intermediate layer 14.

Cover layer 16 features dimples 18 and is translucent. Translucent cover layer 16 provides a view to intermediate layer 14 and may also provide a view to core layer 12.

Figure 1A:
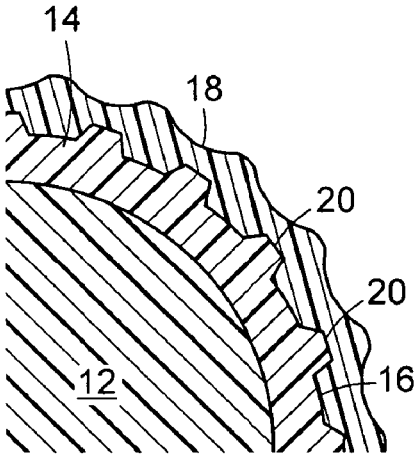
FIG. 1*a* is a partial enlarged view of a portion of the golf ball of FIG. 1.
Figure 1B:
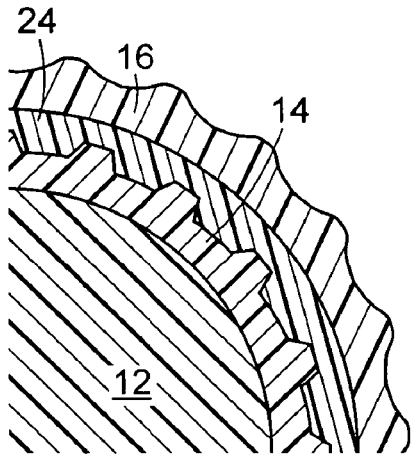
FIG. 1*b* is an alternative embodiment of FIG. 1*a;*

FIG. 1A depicts a golf ball with only one intermediate layer, while FIG. 1B depicts a golf ball with two intermediate layers. Any number of intermediate layers can be used. In this embodiment, outermost intermediate layer 24 encases innermost intermediate layer 14.

A "clear" or "transparent" cover preferably has an average transmittance of visible light (e.g., between about 380 nm and about 770 nm or alternately between about 400 nm and about 700 nm) of at least about 40 percent, preferably at least about 60 percent, more preferably at least about 80 percent. The average transmittance referred to herein is typically measured for incident light normal (i.e., at approximately 90°) to the plane of the object and can be measured using any known light transmission apparatus and method, e.g., a UV-Vis spectrophotometer.

A "translucent" cover preferably has an average transmittance of visible light (e.g., between about 380 nm and about 770 nm or alternately between about 400 nm and about 700 nm) of at least about 10 percent, preferably at least about 20 percent, more preferably at least about 30 percent. As used herein, the term "translucent" includes "transparent."

Figure 2A:
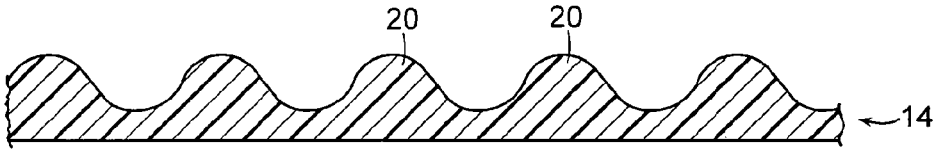
FIGS. 2*a*-2*e* are partial planar views of alternative embodiments of the non-uniform thickness layer in accordance with the present invention.
Figure 2B:
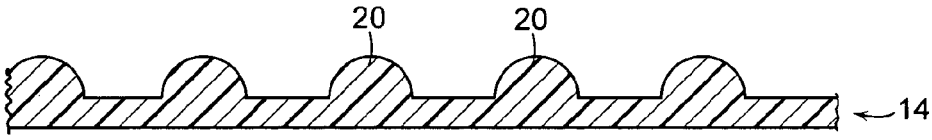
Figure 2C:
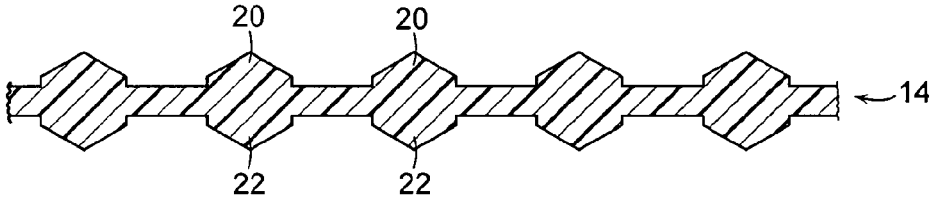
Figure 2D:
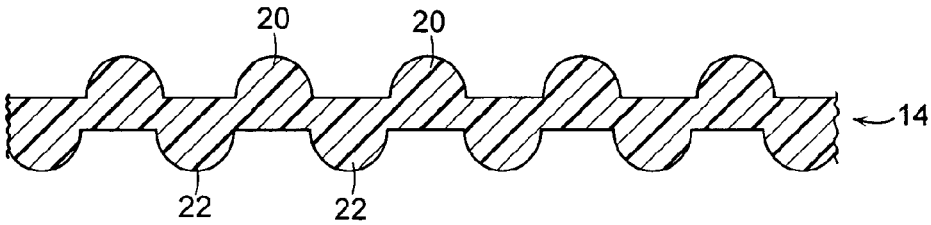
Figure 2E:
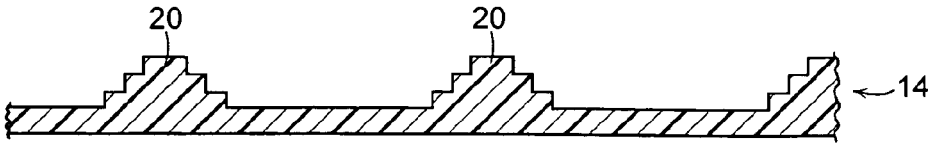

Preferably, intermediate layer 14 also has a non-uniform thickness, i.e., its thickness varies throughout the ball around core 12. As used herein, a non-uniform thickness layer includes, but is not limited to, a layer having projections, webs, ribs or any other structures disposed thereon such that its thickness varies. In accordance with one aspect of the invention shown in FIGS. 1 and 1A, non-uniform thickness layer 14 may comprise a plurality of outer projections 20 disposed on the outer surface of intermediate layer 14. As illustrated, outer projections 20 are made integral with layer 14. However, projections 20 may be made separately and then attached to the intermediate layer 14. Outer projections 20 may have any shape or profile, including but not limited to, trapezoidal as shown in FIGS. 1, 1A and 1B, or sinusoidal, dome or stepped as shown in FIGS. 2A, 2B and 2E, respectively. Additionally, layer 14 may also have inner projections 22 that are disposed on the inner surface of intermediate layer 14, as shown in FIGS. 2C and 2D. Inner projections 22 similarly may have any shape or profile, and may be aligned with the outer projections as shown in FIG. 2C or may by unaligned with the outer projections as shown in FIG. 2D. The inner projections may also be partially aligned with the outer projections, or alternatively may exist without the outer projections. Projections 20 and 22 may also have any of the shapes and profiles disclosed in commonly owned U.S. Pat. No. 6,293,877 B1, including but not limited to, cylindrical, conical, truncated conical, rectangular, pyramidal with polygonal base, truncated pyramidal, and polyhedronal. The disclosure of the '877 patent, including the written description and drawings, is incorporated herein by reference in its entirety.

In a particularly preferred embodiment, golf ball 10 features a translucent cover layer 16, an opaque non-uniform thickness layer 14, and an opaque core layer 12. As used herein, golf ball layers referred to as "opaque" have an average transmittance of visible light less than about 10 percent, and preferably zero percent. That is, opaque layers are not translucent. Core layer 12 and/or intermediate layer 14 feature a visually enhancing means where the visually enhancing means is the same in core layer 12 and intermediate layer 14.

In another preferred embodiment, golf ball 10 features a translucent cover layer 16, an opaque non-uniform thickness layer 14, and an opaque core layer 12. Both core layer 12 and intermediate layer 14 feature a visually enhancing means where the visually enhancing means is different in core layer 12 and intermediate layer 14.

In another preferred embodiment, golf ball 10 features a translucent cover layer 16, a translucent non-uniform thickness layer 14, and an opaque core layer 12. Both core layer 12 and intermediate layer 14 feature a visually enhancing means where the visually enhancing means is different in core layer 12 and intermediate layer 14. In core layer 12, the visually enhancing means is an optical brightener and a titanium dioxide pigment or dye. In intermediate layer 14, the visually enhancing means is a pearlescent.

In another preferred embodiment, golf ball 10 features a translucent cover layer 16, a translucent non-uniform thickness layer 14, and an opaque core layer 12. Core layer 12, intermediate layer 14, and cover layer 16 all feature a visually enhancing means where the visually enhancing means is different in core layer 12 and intermediate layer 14. In core layer 12, the visually enhancing means is an optical brightener and a titanium dioxide pigment or dye. In intermediate layer 14, the visually enhancing means is a pearlescent. Any of the below-listed visually enhancing means other than an optical brightener, a titanium dioxide pigment or dye, or a pearlescent may be incorporated into cover layer 16.

In another preferred embodiment, golf ball 10 features one translucent cover layer 16, a translucent non-uniform thickness layer 14, and an opaque core layer 12. Both cover layer 16 and intermediate layer 14 feature a visually enhancing means.

In another preferred embodiment, golf ball 10 features several translucent cover layers, a translucent non-uniform thickness layer 14, and an opaque core layer 12. At least two of the cover layers and intermediate layer 14 have a visually enhancing means.

Figure 1C:
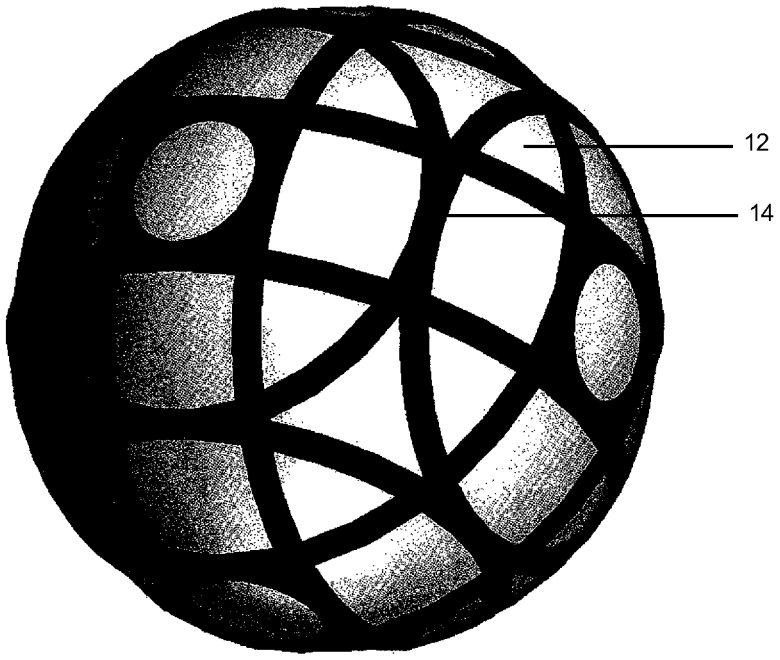
FIGS. 1*c*-1*d* are perspective views of alternative embodiments of the non-uniform thickness layer in accordance with the present invention.
Figure 1D:
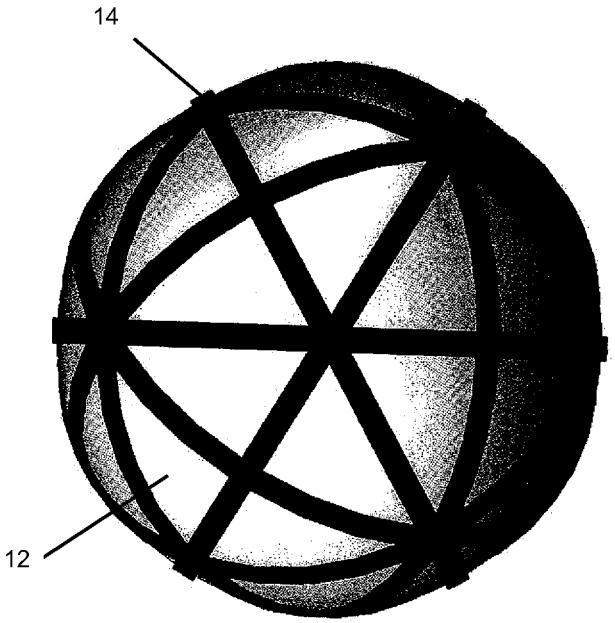

In another preferred embodiment, golf ball 10 features a translucent cover layer 16, an opaque non-uniform thickness layer 14, and a translucent core layer 12. Core layer 12 can feature a visually enhancing means when layer 14 is not continuous, such as those shown in FIGS. 1C-1D.

The present invention includes golf balls wherein any combination of layers features a visually enhancing means as well as golf balls wherein only one layer features a visually enhancing means. The visually enhancing means includes, but is not limited to, any of the below-listed visually enhancing means used singly or in combination with each other. Moreover, the present invention includes embodiments wherein a different visually enhancing means is featured in different layers or wherein a single visually enhancing means is used in multiple layers.

In accordance with one aspect of the present invention, the material properties of the various layers, particularly the core layer 12 and intermediate layer 14 are manipulated to affect the performance characteristics of the golf ball. In some embodiments, the layers of golf ball 10 preferably have different densities such that spin rates may be influenced.

In a preferred embodiment, core layer 12 may be constructed from a low specific gravity material having a specific gravity of less than 0.9 or preferably less than 0.8. Intermediate layer 14 is of non-uniform thickness and is preferably made from a high specific gravity material having a specific gravity of greater than 1.2, more preferably greater than 1.5 and most preferably greater than 1.8. Since intermediate layer 14 is denser and located more radially outward relative to core layer 12, golf ball 10 has a high moment of inertia and a relatively low spin rate.

In another preferred embodiment, intermediate layer 14 is of non-uniform thickness and may be constructed from a low specific gravity material having a specific gravity of less than 0.9 or preferably less than 0.8. Core layer 12, on the other hand, is preferably made from a high specific gravity material having a specific gravity of greater than 1.2, more preferably greater than 1.5 and most preferably greater than 1.8. Since core layer 12 is denser and located more radially inward relative to intermediate layer 14, golf ball 10 has a low moment of inertia and a relatively high spin rate.

Core layer 12 may be spherical, as shown in FIG. 1. In alternate embodiments, the core layer may comprise a non-spherical insert as shown in FIGS. 5-8. Since a non-spherical core insert may be viewable through one or more translucent layers, it is a means for visually enhancing golf ball 10.

The geometries of various core layers may also be utilized to affect the performance characteristics of the golf ball. In some embodiments, spin rates may be influenced by the weight distributions within a non-spherical insert. Examples of non-spherical core inserts which may be used for these purposes can be found in U.S. Patent Application Publication No. 2007/0287558, which is incorporated by reference herein. It is an advantage of the present invention to exploit various visually appealing possibilities that are inherent in the geometries of non-spherical core inserts, as well as the non-uniform thickness layers 14 discussed above. However, the geometries of these inserts must be described before their aesthetic potential is understood.

Figure 4:
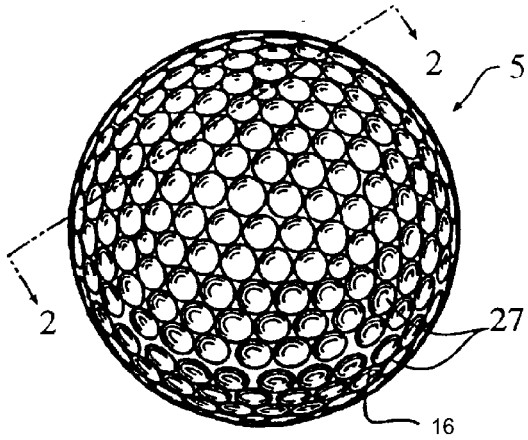
FIG. 4 is a side view of a golf ball according to the present invention.
Figure 5:
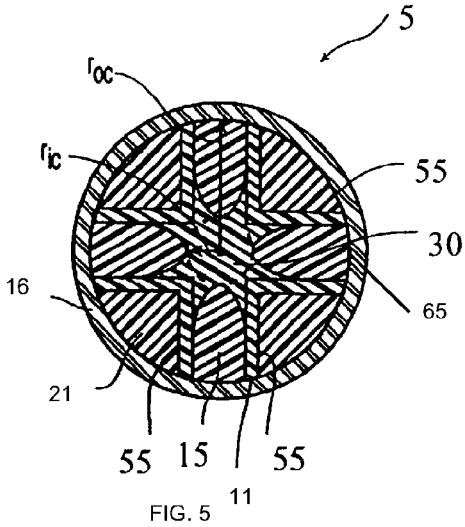
FIG. 5 is a cross-sectional view along the line 2-2 of FIG. 4 of the golf ball according to the present invention.
Figure 6:
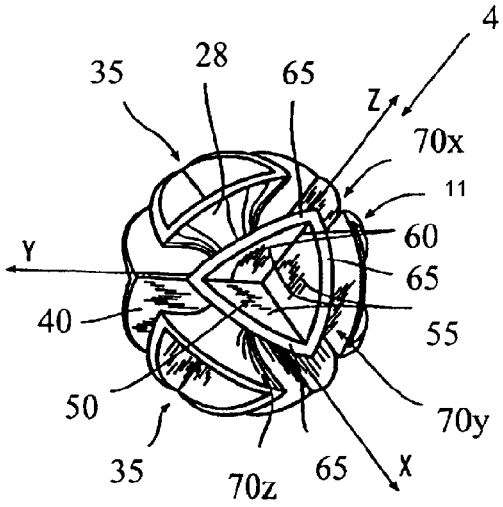
FIG. 6 is a side view of an inner core of the golf ball shown in FIG. 5.
Figure 7:
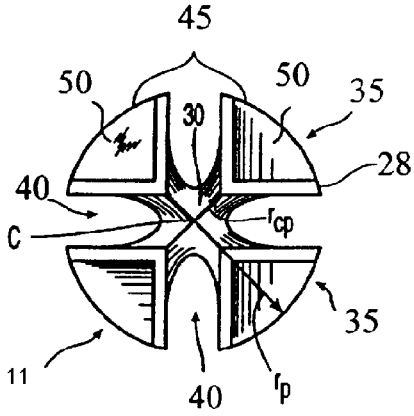
FIG. 7 is a plan view along the arrow 4 of FIG. 6 of the inner core according to the present invention.

Referring to FIG. 4, a golf ball 5 of the present invention is substantially spherical and has a cover 16 with a plurality of dimples 27 formed on the outer surface thereof. Referring to FIGS. 5-7, the golf ball 5 includes an inner core 11, an outer core 15 and 21, and the cover 16 (shown without dimples). The inner core 11 includes a three-dimensional outer surface 28, a center C, a central portion 30, and a plurality of projections 35. The central portion 30 and projections 35 are preferably integrally formed, so that the inner core is a unitary piece. Preferably, inner core 11 is a pre-formed insert that can be overmolded with other materials to form the core of the golf ball.

Referring to FIG. 7, the outer surface 28 of the inner core 11 is defined by the radial distances from the center C. At least two of the radial distances about the outer surface, $r_{cp}$ and $r_p$, are different. The central portion 30 of inner core 11 has a radius, designated by the arrow $r_{cp}$, that extends from the core center C to the outer surface of the central portion. The central portion 30 is solid in this embodiment but may be hollow, as discussed below. Each of the projections 35 extend radially outwardly from the central portion 30, and are spaced from one another to define gaps 40 there between. The projections 35 are shaped so that the inner core 11 is substantially symmetrical. Each projection 35 has an enlarged free end 45 and a substantially conical shape. Each free end 45 includes an open recess 50. Each projection has a radius, designated by the arrow $r_p$, that extends from the core center C to the outer surface 28 at the free end 45. The projection radii $r_p$ differ from the central portion radius $r_{cp}$.

Referring to FIG. 6, each recess 50 is formed by three integral side walls 55. Each of the side walls 55 is shaped like a flat quarter circle. The quarter circle includes two straight edges 60 joined by a curved edge 65. In each projection 35, each of the side walls 55 is joined at the straight edges 60. The curved edges 65 of each of the projections allow the inner core to have a spherical outline.

With reference to a three-dimensional Cartesian Coordinate system, there are perpendicular x, y, and z axii, respectively that form eight octants. There are eight projections 35 with one in each octant of the coordinate system, so that each of the projections 35 forms an octant of the skeletal sphere. Thus, the inner core is symmetrical. The gaps 40 define three perpendicular concentric rings $\mathbf{70}_x$, $\mathbf{70}_y$, and $\mathbf{70}_z$. The subscript for the reference number 70 designates the central axis of the ring about which the ring circumscribes.

Turning to FIGS. 5 and 7, the outer core includes a first section 15 and a second section 21. The first section 15 fills the gaps 40 around the projections 35, and is disposed between the side walls 55 of adjacent projections 35. It is preferred that the diameter of the core which includes the inner core and the outer core is between about 1.00 inches and about 1.64 inches for a ball having a diameter of 1.68 inches.

The second section 21 fills the recesses 50 of each projection 35, and is disposed between the side walls 55 of a single projection 35. The outer core is formed so that the outer core terminates flush with the free end 45 of each projection 35. The outer core has a substantially spherical outer surface. The cover 16 is formed about the inner core 11 and the outer core sections 15 and 21, so that both the inner and outer cores abut the cover.

Referring to FIG. 5, the formation of a golf ball starts with forming the inner core 11. As discussed above, inner core 11 is preferably preformed as an insert. The inner core 11, outer core sections 15 and 21, and the cover 16 can be formed by compression molding, by injection molding, or by casting. These methods of forming cores and covers of this type are well known in the art.

The inner and outer core materials preferably have substantially different material properties so that there is a predetermined relationship between the inner and outer core materials, to achieve the desired playing characteristics of the ball such as the spin rate of the ball. For instance, inner core 11 may be constructed from a low specific gravity material having a specific gravity of less than 0.9 or preferably less than 0.8. Outer core section 21, on the other hand, is preferably made from a high specific gravity material having a specific gravity of greater than 1.2, more preferably greater than 1.5 and most preferably greater than 1.8. Since outer core section 21 is denser and located more radially outward relative to inner core 11, ball 5 has a high moment of inertia and a low spin rate.

Outer core section 15 can be made from a material having a low specific gravity similar to the inner core 11. In this instance, outer core 21 has the highest specific gravity and contributes most to the ball's high moment of inertia. On the other hand, outer core section 15 may have the same specific gravity as outer core 21, so long as the total weight of the ball does not exceed the USGA legal weight of 1.62 ounces.

The non-spherical core inserts of the present invention are not limited to those described above. Examples of other core inserts may be found in the '558 publication. For instance, the core insert may assume the ball and rod geometry of FIG. 10(a), the mushroom and rod geometry of FIG. 10(b), or the anchor and rod geometry of FIG. 10(c) of the '558 publication. The geometries of the core inserts of FIGS. 11(a)-11(c) may also be utilized. The present invention is not limited to the non-spherical core inserts which are disclosed in the '558 publication.

Turning now to the visually enhancing characteristics contributed by the non-spherical core inserts, FIG. 5 depicts golf ball 5 with a non-spherical core insert 11. In a particularly preferred embodiment, the outline of the curved edge 65 of each projection is in contact with translucent cover layer 16. Since cover layer 16 is translucent, the geometrically distinct pattern of curved edge 65 is visible.

Figure 8:
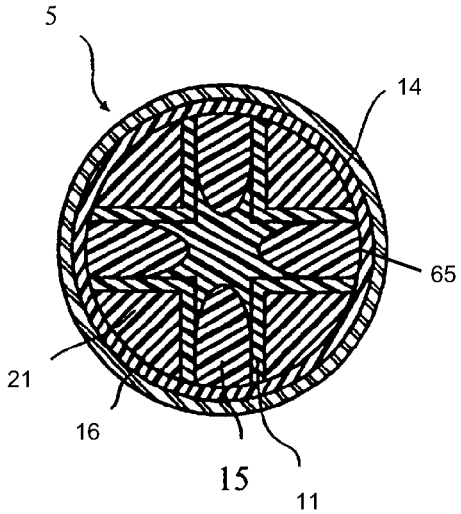
FIG. 8 is a cross-sectional view of a variation of the embodiment shown in FIG. 5.

Referring to FIG. 8, golf ball 5 is shown with a non-spherical core insert 11. In a particularly preferred embodiment, the outline of the curved edge 65 of each projection is in contact with translucent intermediate layer 14. Since cover layer 16 is also translucent, the geometrically distinct pattern formed by the outline of the curved edge 65 of each projection is visible.

This invention also envisions a golf ball 5 with a non-spherical core insert 11, wherein the entirety of non-spherical core insert 11 is contained within a core layer 12. Since cover layer 16, intermediate layer 14, and core layer 12 are all translucent, the geometrically distinct pattern of non-spherical core insert 11 is visible.

In another embodiment featuring non-spherical core insert 11, the core insert is itself translucent. This embodiment also features a translucent cover layer 16, an opaque outer core 15, 21, and a translucent intermediate layer 14, so that translucent non-spherical insert is visible.

It should be emphasized that this invention includes golf balls wherein any combination of the layers (including non-uniform thickness layers) and the non-spherical core insert feature a visually enhancing means, as well as golf balls wherein only one layer or only the non-spherical core insert features a visually enhancing means. It should also be emphasized that the visually enhancing means includes any of the visually enhancing means, mentioned above and discussed below, used singly or in combination. Moreover, the present invention includes embodiments wherein a different visually enhancing means is featured in different layers or in the same layer.

In accordance with another aspect of the invention, the intermediate layer of non-uniform thickness serves as an alignment indicator. In one particular embodiment, a golf ball having a transparent cover layer 16 and a visible intermediate layer 14 of non-uniform thickness is provided. The intermediate layer has a distinct geometric pattern which serves to orient the golf ball in space, thereby indicating the alignment of the golf ball. This feature is particularly advantageous in putting, where indications of the alignment of the golf ball with respect to the contours of the green and the hole are desired.

Figure 3A:
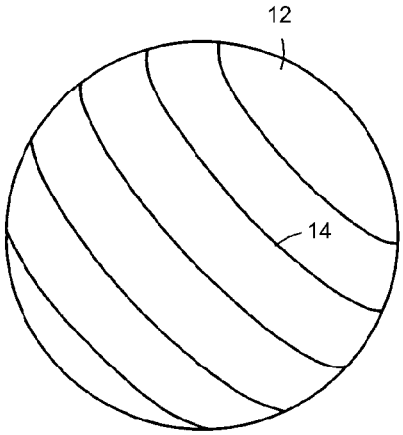
FIGS. 3*a*-3*c* are schematic views of other alternative embodiments of the non-uniform thickness layer in accordance with the present invention.
Figure 3B:
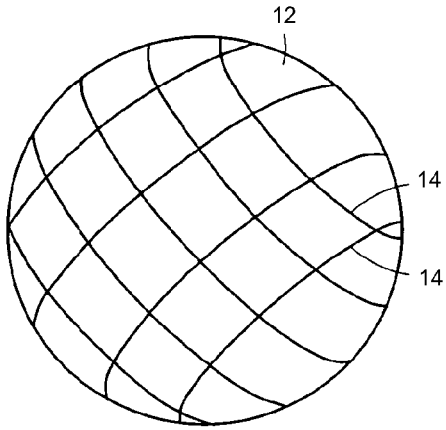
Figure 3C:
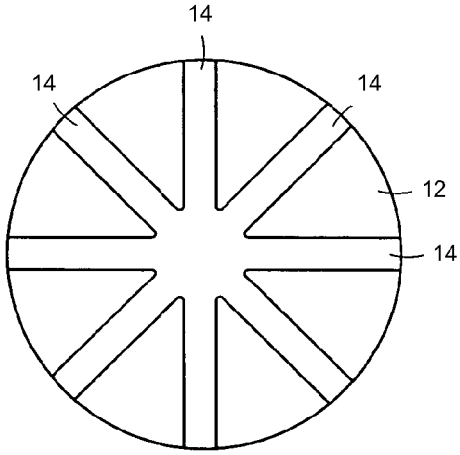

Referring to FIGS. 3A-3C, intermediate layers of non-uniform thickness which may be used for indicating the alignment of the golf ball of which it is a part are depicted. FIG. 3A shows intermediate layer 14 disposed over core 12 in 5 parallel ribs. FIG. 3B shows intermediate layer 14 disposed over core layer 12 in a web of intersecting longitudinal and latitudinal ribs. FIG. 3C shows an intermediate layer 14 disposed over core layer 12 in a circumferential pattern.

It should be emphasized that this invention discloses golf balls that have an intermediate layer 14 which is useful both as an alignment indicator and as a means of adjusting the moment of inertia of the golf ball and thereby its spin rate. It should also be emphasized that intermediate layer 14 may feature a visually enhancing means whether or not it provides the advantage of indicating alignment or the advantage of influencing the spin rate of the golf ball or both.

Visually Enhancing Means

According to the present invention, a visually enhancing means may be incorporated into or disposed onto any combination of the layers of the golf ball to increases the aesthetic appeal of the golf ball and to draw attention to performance improving features. A visually enhancing means is hereby defined to include any combination of metallics, fluorescents, optical brighteners, pearlescents, phosphorescents, luminescents, edge-effect pigments, pigments, dyes and/or tinting agents. Attention should be given to weight added to the golf ball and to where it is distributed in the golf ball by any visually enhancing means, so that a desirable specific gravity, moment of inertia, and overall weight are maintained.

In some embodiments, the visually enhancing means comprises metallics. Metallics are hereby defined to include any metal, but lustrous metals with a high aspect ratio are preferred. Metallics may be in the form of flakes, filler, chopped fiber, or whiskers. Metallics may also comprise iridescent glitter and metallized film. The metallic particles preferably have faces that have an individual reflectance of over 75%, more preferably at least 95%, and most preferably 99-100%. For example, flat particles with two opposite faces can be used.

The particle size of the metallic particles should be smaller than the thickness of the cover, and preferably is very small The particle size preferably is 0.1 mm-1.0 mm more preferably 0.2 mm-0.8 mm, and most preferably 0.25 mm-0.5 mm. The quantity of metallic particles may vary widely, as it will depend upon the desired effect and is best determined experimentally. In general, an aesthetically pleasing reflective appearance can be obtained by using about 0.1-10, or more preferably 1-4, parts by weight metallic particles in the polymeric material.

In some embodiments, the visually enhancing means comprises fluorescents. Fluorescent materials useful in the present invention are commercially available fluorescent pigments and dyes. Some are described in U.S. Pat. Nos. 2,809,954; 2,938,873; 2,851,424; or 3,412,036, which are incorporated by reference herein. A commercial source for these products is Dayglo Color Corporation. As described in the cited patents, these fluorescent daylight materials are organic co-condensates. They are typically composed of melamine, an aldehyde such as formaldehyde, a heterocyclic compound and/or an aromatic sulfonamide. Typical of such materials is Solvent Yellow 44, compounds which are sold by DayGlo under the trademark Saturn Yellow and by Lawter under the trademark Lemon Yellow. The amount of fluorescent material to be used is largely a matter of choice depending on the brightness desired. However, it is preferred that the amount of fluorescent dye be from about 0.01% to about 0.5% by weight of the composition and the amount of fluorescent pigment be from about 0.5% to about 6% by weight of the composition.

In general, fluorescent dyes useful in the present invention include dyes from the thioxanthene, xanthene, perylene, perylene imide, coumarin, thioindigoid, naphthalimide and methine dye classes. Useful dye classes have been more completely described in U.S. Pat. No. 5,674,622, which is incorporated herein by reference in its entirety. Representative yellow fluorescent dye examples include, but are not limited to: Lumogen F Orange™240 (BASF, Rensselaer, N.Y.); Lumogen F Yellow™083 (BASF, Rensselaer, N.Y.); Hostasol Yellow™ 3G (Hoechst-Celanese, Somerville, N.J.); Oraset Yellow™ 8GF (Ciba-Geigy, Hawthorne, N.Y.); Fluorol 088™ (BASF, Rensselaer, N.Y.); Thermoplast F Yellow™ 084 (BASF, Rensselaer, N.Y.); Golden Yellow™ D-304 (DayGlo, Cleveland, Ohio); Mohawk Yellow™ D-299 (DayGlo, Cleveland, Ohio); Potomac Yellow™ D-838 (DayGlo, Cleveland, Ohio); and Polyfast Brilliant Red™ SB (Keystone, Chicago, Ill.).

In some embodiments, the visually enhancing means comprises a single fluorescent dye. In some embodiments, the visually enhancing means comprises a combination of one or more fluorescent dyes and/or or optical brighteners and one or more conventional colorants.

The term optical brightener as used herein is generally the same as that set forth in Kirk-Othmer, Encyclopedia of Chemical Technology, 3d Edition, Volume 4, page 213. As there stated, optical brighteners absorb the invisible ultraviolet portion of the daylight spectrum and convert this energy into the longer-wavelength visible portion of the spectrum. Kirk-Othmer describes typical optical brighteners, including stilbene derivatives, styryl derivatives of benzene and biphenyl, bis(benzazol-2-yl) derivatives, coumarins, carbostyrils, naphthalimides, derivatives of dibenzothiophene-5,5-dioxide, pyrene derivatives, and pyridotriazoles. In accordance with the present invention, any of these or other known optical brighteners including derivatives of 4,4'-diamino stilbene-2,2'-disulfonic acid, 4-methyl-7-diethylamino coumarin and 2,5-bis(5-tert-butyl)-2-benzoxazolyl) thiophene may be used. Uvitex OB is one example of a commercially available optical brightener.

The amount of optically active materials to be included in the visually enhancing means for the cover can range anywhere from about 0.03% level to about 20% or more by weight of the resin solids in the transparent coat. An amount of about 0.3% to about 7% by weight to be a very desirable amount and an amount of about 0.7% to about 6% is more preferred. However, the brightness can be made greater by adding a greater amount of optically active material. Similar quantities of optically active materials are preferred when included in the core layer or the intermediate layer.

Because of the relatively unstable nature of optically active pigments and dyes, and especially because of the outside use to which golf balls are put, it is preferred that an ultraviolet (UV) stabilizer be added to the urethane and urea cover compositions. If either the optically active material or the cover material comes with sufficient UV stabilizer, it is obviously not beneficial to add more. However, UV absorbers are preferably present in the amount of from about 0.1% to about 3.0% by weight of the cover, and more preferably from about 0.5% to about 2.0%.

In some embodiments, the visually enhancing means comprises optical brighteners used in combination with inorganic tinting agents such as ultramarine blue.

In some embodiments, the visually enhancing means comprises pearlescents such as those pearlescent pigments sold by the Mearle Corporation.

In some embodiments, the visually enhancing means comprises a conventional dye. Examples of nonfluorescent dye classes that can be used in the present invention include azo, heterocyclic azo, anthraquinone, benzodifuranone, polycyclic aromatic carbonyl, indigoid, polymethine, styryl, di- and tri-aryl carbonium, phthalocyanines, quinopphthalones, sulfur, nitro and nitroso, stilbene, and formazan dyes. The concentration of dye needed is specific to each application. However, typically between about 0.01 and 1 weight percent of regular dye based on total composition cover material is preferable. It will be understood that articles with dye loadings outside this range can be used in accordance with this invention.

In some embodiments, the visually enhancing means comprises edge-effect pigments. Edge-effect pigments attracted to the edges or sharper contours of the surfaces to which they are applied and thus leave higher concentrations of pigment in such areas. Edge-effect pigments are sold by Bayer Co under the description "Fantasia Colors and Special Effects" and include Leda Edge-Effects. Edge-effect pigments are also sold by Merck Co under the tradenames Miraval, Iriodin, Colorstream, Xirallic, Solarflair, Lazerflair, and Florapearl.

Materials

Materials used to construct the golf ball of the present application include but are not limited to partially neutralized ionomers; fully neutralized ionomers; diene-rubber compositions including polybutadiene; single-site catalyzed polyolefins including metallocene, polyethylene, polyethylene copolymers, and ethylene-propylene copolymers; polyurethane; polyurea; polyurethane-polyurea hybrid materials; epoxies; silicones; and polyurethane-silicone copolymers. Such materials are discussed in parent application Ser. No. 11/707,493 which has already been incorporated herein by reference in its entirety, as well as U.S. Pat. No. 6,773,364 which is incorporated herein by reference in its entirety.

Cover Layer Materials

Materials which may be used to construct the cover layer of the present invention include a polyurethane which comprises the product of polyisocyanate, at least one polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("$H_{12}$MDI"); p-phenylene diisocyanate ("PPDI"); m-phenylene diisocyanate ("MPDI"); toluene diisocyanate ("TDI"); 3,3'-dimethyl-4,4'-biphenylene diisocyanate ("TODI"); isophoronediisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate ("TMDI"); tetracene diisocyanate; napthalene diisocyanate; anthracene diisocyanate; and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1% to about 0.5% free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14% unreacted NCO groups. Preferably, the at least one polyisocyanate has less than about 7.9% NCO, more preferably, between about 2.5% and about 7.8%, and most preferably, between about 4% to about 6.5%.

Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

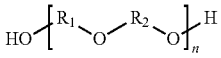

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the

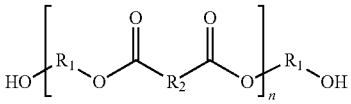

invention. Preferred polyester polyols have the generic structure: where $R_1$ and $R_2$ are straight or branched hydrocarbon chains, each containing from 1 to about 20 carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups.

In another embodiment, polycaprolactone polyols are included in the materials of the invention.

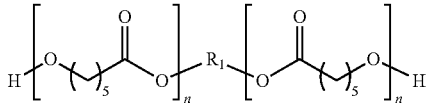

Preferably, any polycaprolactone polyols have the generic structure: where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

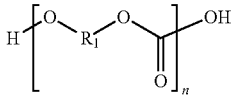

where $R_1$ is predominantly bisphenol A units -(p-$C_6H_4$)—C($CH_3$)$_2$-(p-$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls.

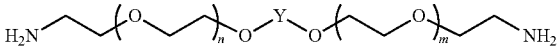

Preferred polyamine curatives have the general formula: where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (tradename ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; para, para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the

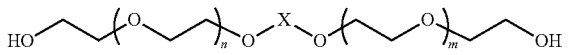

following general chemical structure: where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy) ethoxy] benzene, and 1,3-bis-{2-[2-(2-hydroxyethoxy)ethoxy] ethoxy}benzene; 1,4-butanediol; resorcinol-di-(β-hydroxyethyl)ether; and hydroquinone-di-(β-hydroxyethyl) ether; and mixtures thereof Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

The invention is further directed to a golf ball including a transparent cover layer formed from a composition including at least one polyurea formed from a polyurea prepolymer and a curing agent. In one embodiment, the polyurea prepolymer includes at least one diisocyanate and at least one polyether amine.

In this aspect of the invention the diisocyanate is preferably saturated, and can be selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl)dicyclohexane; isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. The saturated diisocyanate is preferably selected from the group consisting of isophoronediisocyanate, 4,4'-dicyclohexylmethane diisocyanate, 1,6-hexamethylene diisocyanate, or a combination thereof.

In another embodiment, the diisocyanate is an aromatic aliphatic isocyanate selected from the group consisting of meta-tetramethylxylene diisocyanate; para-tetramethylxylene diisocyanate; trimerized isocyanurate of polyisocyanate; dimerized uredione of polyisocyanate; modified polyisocyanate; and mixtures thereof.

The polyether amine may be selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof. In one embodiment, the polyether amine has a molecular weight of about 1000 to about 3000.

The curing agent may be selected from the group consisting of hydroxy-terminated curing agents, amine-terminated curing agents, and mixtures thereof, and preferably has a molecular weight from about 250 to about 4000.

In one embodiment, the hydroxy-terminated curing agents are selected from the group consisting of ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy)ethoxy]cyclohexane; 1,3-bis-{2-[2-(2-hydroxyethoxy)ethoxy]ethoxy}cyclohexane; trimethylolpropane; polytetramethylene ether glycol, preferably having a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

In one embodiment, the composition further includes a catalyst that can be selected from the group consisting of a bismuth catalyst, zinc octoate, di-butyltin dilaurate, di-butyltin diacetate, tin(II)chloride, tin(IV)chloride, di-butyltin dimethoxide, dimethyl-bis[1-oxonedecyl)oxy]stannane, di-n-octyltin bis-isooctyl mercaptoacetate, triethylenediamine, triethylamine, tributylamine, oleic acid, acetic acid; delayed catalysts, and mixtures thereof. The catalyst may be present from about 0.005 percent to about 1 percent by weight of the composition.

Any method available to one of ordinary skill in the art may be used to combine the polyisocyanate, polyol or polyamine, and curing agent of the present invention. One commonly employed method, known in the art as a one-shot method, involves concurrent mixing of the polyisocyanate, polyol or polyether amine, and curing agent. This method results in a mixture that is inhomogenous (more random) and affords the manufacturer less control over the molecular structure of the resultant composition. A preferred method of mixing is known as the prepolymer method. In this method, the polyisocyanate and the polyol or polyether amine are mixed separately prior to addition of the curing agent. This method seems to afford a more homogeneous mixture resulting in a more consistent polymer composition.

An optional filler component may be chosen to adjust the density of the blends described herein, but care should be taken to make sure the optical properties of the cover or the intermediate layer remain as desired. Examples of useful fillers include zinc oxide ("ZnO"), barium sulfate, calcium oxide, calcium carbonate, and silica, as well as any salts and oxides thereof. Additional fillers, such as foaming agents, glass and/or plastic microspheres, and various metals, can be added to the polyurethane or polyurea compositions of the present invention, in amounts as needed, for their well-known purposes.

It is also preferred that the composition of the present invention include at least one color stabilizer. Color stabilizers include, but are not limited to, UV absorbers, radical scavengers, such as hindered amine light stabilizers ("HALS"), thermal stabilizers and antioxidants, quenchers, such as nickel quenchers, hydroperoxide decomposers, fillers, and mixtures thereof. It has been determined that fillers, such as ZnO and TiO2, pigments, and paints, have some UV absorbing and/or blocking qualities, and as such, can contribute to the color stability of the composition.

Suitable UV absorbers include, but are not limited to, triazines, benzoxazinones, benzotriazoles, benzophenones, benzoates, formamidines, cinnamates/propenoates, aromatic propanediones, benzimidazoles, cycloaliphatic ketones, formanilides (including oxamides), cyanoacrylates, benzopyranones, salicylates, and mixtures thereof. Without wishing to be bound by any particular theory, it is believed that these compounds absorb harmful UV light and rapidly convert the light into harmless energy, such that the compounds reduce or prevent the rapid degradation of color in many conventional golf balls.

Intermediate Layer Materials

According to the present invention, the intermediate layer can include any materials known to those of ordinary skill in the art including thermoplastic and thermosetting materials. For example, the intermediate layer may be formed from any of the polyurea, polyurethane, and polybutadiene materials discussed above. However, certain thermoplastic materials are preferable.

The intermediate layer may also likewise include one or more homopolymeric or copolymeric materials, such as:

a. Vinyl resins, such as those formed by the polymerization of vinyl chloride, or by the copolymerization of vinyl chloride with vinyl acetate, acrylic esters or vinylidene chloride;
b. Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst or a metallocene catalyst;
c. Polyurethanes, such as those prepared from polyols and diisocyanates or polyisocyanates and those disclosed in U.S. Pat. No. 5,334,673;
d. Polyureas, such as those disclosed in U.S. Pat. No. 5,484,870;
e. Polyamides, such as poly(hexamethylene adipamide) and others prepared from diamines and dibasic acids, as well as those from amino acids such as poly(caprolactam), and blends of polyamides with SURLYN, polyethylene, ethylene copolymers, ethyl-propylene-non-conjugated diene terpolymer, and the like;
f. Acrylic resins and blends of these resins with poly vinyl chloride, elastomers, and the like;
g. Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX, sold by ELF Atochem of Philadelphia, Pa.;
h. Polyphenylene oxide resins or blends of polyphenylene oxide with high impact polystyrene as sold under the trademark NORYL by General Electric Company of Pittsfield, Mass.;
i. Thermoplastic polyesters, such as polyethylene terephthalate, polybutylene terephthalate, polyethylene terephthalate/glycol modified and elastomers sold under the trademarks HYTREL by E.I. DuPont de Nemours & Co. of Wilmington, Del., and LOMOD by General Electric Company of Pittsfield, Mass.;

Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and blends of thermoplastic rubbers with polyethylene, propylene, polyacetal, nylon, polyesters, cellulose esters, and the like.

In one embodiment, the intermediate layer includes polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof.

As briefly mentioned above, the intermediate layer may include ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The intermediate layer may also include at least one ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. In another embodiment, the acrylic or methacrylic acid is present in about 8 to 35 weight percent, more preferably 8 to 25 weight percent, and most preferably 8 to 20 weight percent.

The ionomer also may include so-called "low acid" and "high acid" ionomers, as well as blends thereof In general, ionic copolymers including up to about 15 percent acid are considered "low acid" ionomers, while those including greater than about 15 percent acid are considered "high acid" ionomers.

A low acid ionomer is believed to impart high spin. Thus, in one embodiment, the intermediate layer includes a low acid ionomer where the acid is present in about 10 to 15 weight percent and optionally includes a softening comonomer, e.g., iso- or n-butylacrylate, to produce a softer terpolymer. The softening comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

In another embodiment, the intermediate layer includes at least one high acid ionomer, for low spin rate and maximum distance. In this aspect, the acrylic or methacrylic acid is present in about 15 to about 35 weight percent, making the ionomer a high modulus ionomer. In one embodiment, the high modulus ionomer includes about 16 percent by weight of a carboxylic acid, preferably from about 17 percent to about 25 percent by weight of a carboxylic acid, more preferably from about 18.5 percent to about 21.5 percent by weight of a carboxylic acid. In some circumstances, an additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

The acid moieties of the highly-neutralized polymers ("HNP"), typically ethylene-based ionomers, are preferably neutralized greater than about 70 percent, more preferably greater than about 90 percent, and most preferably at least about 100 percent. The HNP's may be also be blended with a second polymer component, which, if containing an acid group, may be neutralized in a conventional manner, by organic fatty acids, or both. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like.

In this embodiment, the acid copolymers can be described as E/X/Y copolymers where E is ethylene, X is an $\alpha,\beta$-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

The organic acids are aliphatic, mono-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, bebenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

Thermoplastic polymer components, such as copolyetheresters, copolyesteresters, copolyetheramides, elastomeric polyolefins, styrene diene block copolymers and their hydrogenated derivatives, copolyesteramides, thermoplastic polyurethanes, such as copolyetherurethanes, copolyesterurethanes, copolyureaurethanes, epoxy-based polyurethanes, polycaprolactone-based polyurethanes, polyureas, and polycarbonate-based polyurethanes fillers, and other ingredients, if included, can be blended in either before, during, or after the acid moieties are neutralized, thermoplastic polyurethanes.

Examples of these materials are disclosed in U.S. Patent Application Publication Nos. 2001/0018375 and 2001/0019971, which are incorporated herein in their entirety by express reference thereto.

The ionomer compositions may also include at least one grafted metallocene catalyzed polymer. Blends of this embodiment may include about 1 phr to about 100 phr of at least one grafted metallocene catalyzed polymer and about 99 phr to 0 phr of at least one ionomer, preferably from about 5 phr to about 90 phr of at least one grafted metallocene catalyzed polymer and about 95 phr to about 10 phr of at least one ionomer, more preferably from about 10 phr to about 75 phr of at least one grafted metallocene catalyzed polymer and about 90 phr to about 25 phr of at least one ionomer, and most preferably from about 10 phr to about 50 phr of at least one grafted metallocene catalyzed polymer and about 90 phr to about 50 phr of at least one ionomer. Where the layer is foamed, the grafted metallocene catalyzed polymer blends may be foamed during molding by any conventional foaming or blowing agent.

In another embodiment, the intermediate layer includes at least one primarily or fully non-ionomeric thermoplastic material. Suitable non-ionomeric materials include polyamides and polyamide blends, grafted and non-grafted metallocene catalyzed polyolefins or polyamides, polyamide/ionomer blends, polyamide/nonionomer blends, polyphenylene ether/ionomer blends, and mixtures thereof. Examples of grafted and non-grafted metallocene catalyzed polyolefins or polyamides, polyamide/ionomer blends, polyamide/nonionomer blends are disclosed in co-pending U.S. Pat. No. 6,800,690, filed May 6, 2002, entitled "Golf Balls Incorporating Polyamide Polymers," the entire disclosure of which is incorporated by reference herein.

In one embodiment, polyamide homopolymers, such as polyamide 6,18 and polyamide 6,36 are used alone, or in combination with other polyamide homopolymers. In another embodiment, polyamide copolymers, such as polyamide 6,10/6,36, are used alone, or in combination with other polyamide copolymers. Other examples of suitable polyamide homopolymers and copolymers include polyamide polyamide 4, polyamide 6, polyamide 7, polyamide 11, polyamide 12 (manufactured as Rilsan AMNO by Elf Atochem of Philadelphia, Pa.), polyamide 13, polyamide 4,6, polyamide 6,6, polyamide 6,9, polyamide 6,10, polyamide 6,12, polyamide 6,36, polyamide 12,12, polyamide 13,13, polyamide 6/6,6, polyamide 6,6/6,10, polyamide 6/6,T wherein T represents terephthalic acid, polyamide 6/6,6/6,10, polyamide 6,10/6,36, polyamide 66,6,18, polyamide 66,6, 36, polyamide 6/6,18, polyamide 6/6,36, polyamide 6/6,10/6,18, polyamide 6/6,10/6,36, polyamide 6,10/6,18, polyamide 6,12/6,18, polyamide 6,12/6,36, polyamide 6/66/6,18, polyamide 6/66/6, 36, polyamide 66/6,10/6,18, polyamide 66/6,10/6, 36, polyamide 6/6,12/6,18, polyamide 6/6,12/6, 36, and mixtures thereof.

As mentioned above, any of the above polyamide homopolymer, copolymer, and homopolymer/copolymer blends may be optionally blended with nonionomer polymers, such as nonionomer thermoplastic polymers, nonionomer thermoplastic copolymers, nonionomer TPEs, and mixtures thereof.

One specific example of a polyamide-nonionomer blend is a polyamide-metallocene catalyzed polymer blend. The blended compositions may include grafted and/or non-grafted metallocene catalyzed polymers. Grafted metallocene catalyzed polymers, functionalized with pendant groups, such as maleic anhydride, and the like, are available in experimental quantities from DuPont. Grafted metallocene catalyzed polymers may also be obtained by subjecting a commercially available non-grafted metallocene catalyzed polymer to a post-polymerization reaction involving a monomer and an organic peroxide to provide a grafted metallocene catalyzed polymer with the desired pendant group or groups.

Another example of a polyamide-nonionomer blend is a polyamide and non-ionic polymers produced using non-metallocene single-site catalysts. As used herein, the term "non-metallocene catalyst" or "non-metallocene single-site catalyst" refers to a single-site catalyst other than a metallocene catalyst. Examples of suitable single-site catalyzed polymers are disclosed in co-pending U.S. Pat. No. 6,958,379, of which the entire disclosure is incorporated by reference herein.

The intermediate layer may also be formed from the compositions disclosed in U.S. Pat. No. 5,688,191, the entire disclosure of which is incorporated by reference herein, and U.S. Pat. No. 6,773,364, previously incorporated by reference above.

Construction

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like. A method of injection molding using a split vent pin can be found in co-pending U.S. Pat. No. 6,877,974, filed Dec. 22, 2000, entitled "Split Vent Pin for Injection Molding." Examples of retractable pin injection molding may be found in U.S. Pat. Nos. 6,129,881; 6,235,230; and 6,379,138. These molding references are incorporated in their entirety by reference herein. In addition, a chilled chamber, i.e., a cooling jacket, such as the one disclosed in U.S. Pat. No. 6,936,205, filed Nov. 22, 2000, entitled "Method of Making Golf Balls" may be used to cool the compositions of the invention when casting, which also allows for a higher loading of catalyst into the system.

Conventionally, compression molding and injection molding are applied to thermoplastic materials, whereas RIM, liquid injection molding, and casting are employed on thermoset materials. These and other manufacture methods are disclosed in U.S. Pat. Nos. 6,207,784 and 5,484,870, the disclosures of which are incorporated herein by reference in their entirety.

The cores of the invention may be formed by any suitable method known to those of ordinary skill in art. When the cores are formed from a thermoset material, compression molding is a particularly suitable method of forming the core. In a thermoplastic core embodiment, on the other hand, the cores may be injection molded.

For example, methods of converting the cis-isomer of the polybutadiene resilient polymer core component to the trans-isomer during a molding cycle are known to those of ordinary skill in the art. Suitable methods include single pass mixing (ingredients are added sequentially), multi-pass mixing, and the like. The crosslinking agent, and any other optional additives used to modify the characteristics of the golf ball center or additional layer(s), may similarly be combined by any type of mixing. Suitable mixing equipment is well known to those of ordinary skill in the art, and such equipment may include a Banbury mixer, a two-roll mill, or a twin screw extruder. Suitable mixing speeds and temperatures are well-known to those of ordinary skill in the art, or may be readily determined without undue experimentation.

The mixture can be subjected to, e.g., a compression or injection molding process, and the molding cycle may have a single step of molding the mixture at a single temperature for a fixed-time duration. In one embodiment, a single-step cure cycle is employed. Although the curing time depends on the various materials selected, a suitable curing time is about 5 to about 18 minutes, preferably from about 8 to about 15 minutes, and more preferably from about 10 to about 12 minutes. An example of a single step molding cycle, for a mixture that contains dicumyl peroxide, would hold the polymer mixture at 171° C. (340° F.) for a duration of 15 minutes. An example of a two-step molding cycle would be holding the mold at 143° C. (290° F.) for 40 minutes, then ramping the mold to 171° C. (340° F.) where it is held for a duration of 20 minutes. Those of ordinary skill in the art will be readily able to adjust the curing time based on the particular materials used and the discussion herein.

Furthermore, U.S. Pat. Nos. 6,180,040 and 6,180,722 disclose methods of preparing dual core golf balls. The disclosures of these patents are hereby incorporated by reference in their entirety.

The intermediate layer may also be formed from using any suitable method known to those of ordinary skill in the art. For example, an intermediate layer may be formed by blow molding and covered with a dimpled cover layer formed by injection molding, compression molding, casting, vacuum forming, powder coating, and the like.

The castable reactive liquid polyurethanes and polyurea materials of the invention may be applied over the inner ball using a variety of application techniques such as casting, injection molding spraying, compression molding, dipping, spin coating, or flow coating methods that are well known in the art. In one embodiment, the castable reactive polyurethanes and polyurea material is formed over the core using a combination of casting and compression molding. Conventionally, compression molding and injection molding are applied to thermoplastic cover materials, whereas RIM, liquid injection molding, and casting are employed on thermoset cover materials.

U.S. Pat. No. 5,733,428, the entire disclosure of which is hereby incorporated by reference, discloses a method for foaming a polyurethane cover on a golf ball core. Because this method relates to the use of both casting thermosetting and thermoplastic material as the golf ball cover, wherein the cover is formed around the core by mixing and introducing the material in mold halves, the polyurea compositions may also be used employing the same casting process.

For example, once the polyurea composition is mixed, an exothermic reaction commences and continues until the material is solidified around the core. It is important that the viscosity be measured over time, so that the subsequent steps of filling each mold half, introducing the core into one half and closing the mold can be properly timed for accomplishing centering of the core cover halves fusion and achieving overall uniformity. A suitable viscosity range of the curing urea mix for introducing cores into the mold halves is determined to be approximately between about 2,000 cP and about 30,000 cP, with the preferred range of about 8,000 cP to about 15,000 cP.

To start the cover formation, mixing of the prepolymer and curative is accomplished in a motorized mixer inside a mixing head by feeding through lines metered amounts of curative and prepolymer. Top preheated mold halves are filled and placed in fixture units using centering pins moving into apertures in each mold. At a later time, the cavity of a bottom mold half, or the cavities of a series of bottom mold halves, is filled with similar mixture amounts as used for the top mold halves. After the reacting materials have resided in top mold halves for about 40 to about 100 seconds, preferably for about 70 to about 80 seconds, a core is lowered at a controlled speed into the gelling reacting mixture.

A ball cup holds the ball core through reduced pressure (or partial vacuum). Upon location of the core in the halves of the mold after gelling for about 4 to about 12 seconds, the vacuum is released allowing the core to be released. In one embodiment, the vacuum is released allowing the core to be released after about 5 seconds to 10 seconds. The mold halves, with core and solidified cover half thereon, are removed from the centering fixture unit, inverted and mated with second mold halves which, at an appropriate time earlier, have had a selected quantity of reacting polyurea prepolymer and curing agent introduced therein to commence gelling.

Similarly, U.S. Pat. No. 5,006,297 and U.S. Pat. No. 5,334,673 both also disclose suitable molding techniques that may be utilized to apply the castable reactive liquids employed in the present invention. However, the method of the invention is not limited to the use of these techniques; other methods known to those skilled in the art may also be employed. For instance, other methods for holding the ball core may be utilized instead of using a partial vacuum.

Core Construction

According to the present invention, the construction of the core layer may be solid, semi-solid, hollow, fluid-filled or powder-filled, one-piece or multi-component cores. The term "semi-solid" as used herein refers to a paste, a gel, or the like. Any core material known to one of ordinary skill in that art is suitable for use in the golf balls of the invention. Suitable core materials include thermoset materials, such as rubber, styrene butadiene, polybutadiene, isoprene, polyisoprene, trans-isoprene, as well as thermoplastics such as ionomer resins, polyamides or polyesters, and thermoplastic and thermoset polyurethane elastomers. As mentioned above, the polyurethane and polyurea compositions of the present invention may also be incorporated into any component of a golf ball, including the core.

In one embodiment, the golf ball core is formed from a composition including a base rubber (natural, synthetic, or a combination thereof), a crosslinking agent, and a filler. In another embodiment, the golf ball core is foamed from a reaction product that includes a cis-to-trans catalyst, a resilient polymer component having polybutadiene, a free radical source, and optionally, a crosslinking agent, a filler, or both. Various combinations of polymers, cis-to-trans catalysts, fillers, crosslinkers, and a source of free radicals, such as those disclosed in co-pending and co-assigned U.S. patent application Ser. No. 10/190,705, entitled "Low Compression, Resilient Golf Balls With Rubber Core," filed Jul. 9, 2002, the entire disclosure of which is incorporated by reference herein, may be used to form the reaction product. Although this polybutadiene reaction product is discussed in a section pertaining to core compositions, the present invention also contemplates the use of the reaction product to form at least a portion of any component of a golf ball.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising:

a core comprising a substantially symmetrical inner core and an optionally translucent outer core adjacent the inner core; and a cover encasing the core wherein the cover is translucent;

said inner core comprising a center C and a three dimensional outer surface defined by a plurality of radial distances from the center C including at least two radial distances $r_{cp}$ and $r_p$ wherein $r_{cp}$ is different than $r_p$;

wherein a central portion of the inner core extends from the center C to the outer surface the radial distance $r_{cp}$;

and a plurality of substantially conically shaped projections extend radially outwardly from the central portion and have a radius extending from the center C to the outer surface the radius $r_p$.

2. The golf ball of claim 1, wherein the inner core comprises a visually enhanced layer comprising metallics, fluorescents, phosphorescents, luminescents, pearlescents, optical brighteners, edge-effect pigments, pigments, dyes and/or tinting agents.

3. The golf ball of claim 2, wherein metallics comprise flakes, filler, chopped fibers, whiskers, iridescent glitter, and/or metallized film.

4. The golf ball of claim 1, wherein said inner core is at least partially visible.

5. The golf ball of claim 1, wherein the specific gravity of said inner core is different than the specific gravity of the outer core.

6. The golf ball of claim 1, wherein the outer core comprises a visually enhanced layer comprising metallics, fluorescents, phosphorescents, luminescents, pearlescents, optical brighteners, edge-effect pigments, pigments, dyes and/or tinting agents.

* * * * *